US005142762A

United States Patent [19]

Dziorny et al.

[11] Patent Number: 5,142,762

[45] Date of Patent: Sep. 1, 1992

[54] AIR CYCLE MACHINE ALIGNMENT

[75] Inventors: Paul J. Dziorny, Manchester; Christopher McAuliffe, Windsor, both of Conn.

[73] Assignee: United Technologies Corporation, Hartford, Conn.

[21] Appl. No.: 603,979

[22] Filed: Oct. 22, 1990

[51] Int. Cl.[5] ..... B23B 35/00; B23P 17/00

[52] U.S. Cl. ..... 29/467; 29/559; 408/1 R; 408/72 R

[58] Field of Search ..... 29/467, 281.1, 404, 29/406, 423, 425, 26 R, 464, 468, 888.02, 888.022, 271, 559; 408/1 R, 72 R, 79

[56] References Cited

U.S. PATENT DOCUMENTS

| | | | |
|---|---|---|---|
| 2,897,586 | 8/1959 | Hatch | 29/467 X |
| 3,081,526 | 3/1963 | Donnell | 29/423 X |
| 3,083,444 | 4/1963 | Mitchell et al. | 29/423 |
| 3,237,295 | 3/1966 | Konzak | 29/281.1 X |
| 3,357,875 | 12/1967 | Corbin, Jr. | 29/423 X |
| 4,016,636 | 4/1977 | Schneider et al. | 29/467 X |
| 4,349,957 | 9/1982 | Lundin | 29/467 X |
| 4,458,405 | 7/1984 | Cavagnero et al. | 29/467 |
| 4,615,651 | 10/1986 | Vinceller et al. | 408/72 R |
| 5,042,150 | 8/1991 | Fraser, Jr. | 29/464 X |

*Primary Examiner*—Joseph M. Gorski

[57] ABSTRACT

During assembly, individual segments (10, 12, 14) comprising a housing (18) designed to encase and support a rotating assembly are positioned on a fixture (16) and releasably joined. The fixture (16) is adapted to engage the annular volumes (20, 22, 24, 26) that locate the radial support means chosen to support the rotating assembly.

1 Claim, 1 Drawing Sheet

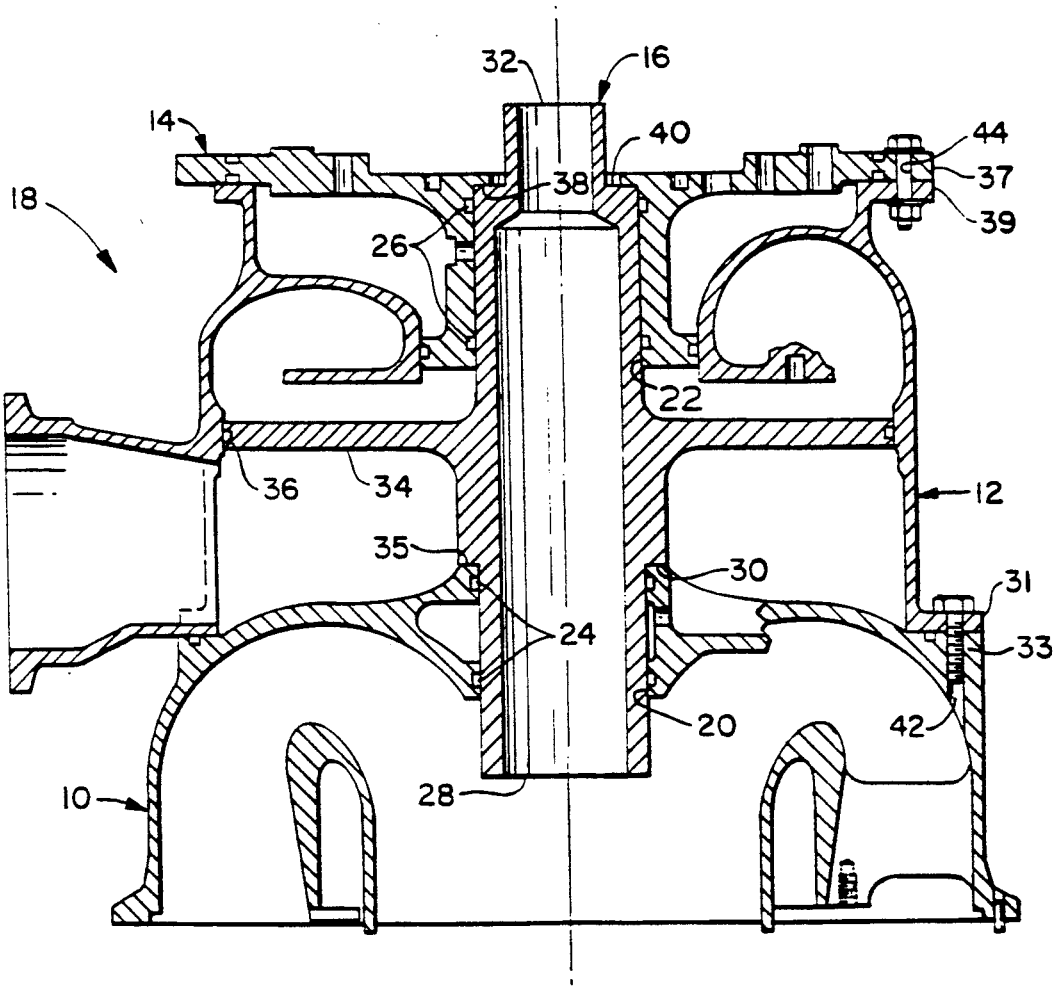
32
16
14
40
44
37
39
38
18
26
22
36
34
12
35
30
31
24
33
20
42
10
28

AIR CYCLE MACHINE ALIGNMENT

DESCRIPTION

1. Technical Field

This invention relates to the manufacture and assembly of air cycle machines.

2. Background Art

Coolant for aircraft avionics and cabins is typically supplied by an environmental control system. In these systems, compressed supply air is first further compressed in a compressor and cooled in a heat exchanger before it is expanded in a turbine. Turbine outlet air, cooled by this expansion, then passes to the aircraft. The power produced by the turbine is absorbed by both the compressor and a fan used to draw cool air through the heat exchanger. In most systems, these three rotating components, the fan, the compressor, and the turbine, are all connected by a single shaft and packaged into a single assembly.

In this assembly, referred to as an air cycle machine, a pair of hydrodynamic journal bearings are used to radially locate and support the shaft. The inner races of these journal bearings are typically integrally machined with the shaft. The journal bearing outer races are separate cylindrical sleeves. A pin protruding radially from each outer race passes completely through the housing encircling the outer race, axially locating the bearing assembly. Each bearing is radially located by a pair of O-rings installed in glands encircling the outer race. Since the housing does not directly contact the bearing assembly, the centerline, or rotational axis, of each journal bearing is determined by th relative orientations of the inside diameters of the two O-ring glands.

Since two journal bearings are used to support the shaft, for proper air cycle machine operation, both bearing centerlines must be located as close to the same axis as possible. In most machines, each journal bearing is mounted in a separate segment of the housing. Pilots, matched sets of two corresponding machined annular surfaces located at the outermost diameter where each housing segment contacts another segment, maintain the relative radial locations of adjacent segments. In each matched pilot set, a first surface is located on the inside of the outer housing wall of one segment. A second surface with an included O-ring gland is located on the outside of the outer housing wall of the adjacent segment. When assembled, the second surface fits inside the first, and the machined first inner surface rests on an O-ring installed into this gland, fixing the relative radial orientation of the two segments.

If the pilots on each housing segment are concentric with the journal bearing bore, when the housing is assembled perfect machine alignment is achieved. However, given the large diameter of the pilots, relative to the bearing bore diameters, machining pilot surfaces onto the housing segments to such close tolerances is both difficult and expensive. In some assembly processes, therefore, after the housing segments are assembled the journal bearing bores are match machined to ensure that the bearing assembly centerlines align. With this approach, the pre-assembled concentricity of the journal bores and the housing pilot surfaces may then be maintained to looser tolerances.

Match machining is accomplished by rigidly fixing the assembled housing segments and passing a boring bar along the desired shaft centerline. When the bores have been machined to the desired inside diameter, the second tool is then used to cut the O-ring glands. Since the inside diameters of these glands determine the orientation of the bearing assemblies, the glands must be carefully machined to ensure uniform measurements. For optimal uniformity and concentricity, the cutting tools used to machine both the bores and the O-ring glands enter the rigidly-held housing assembly at one end and traverse the length of the assembly interior, cutting both bores. While this approach ensures improved bearing alignment, it also requires that the bore and gland-cutting tools be mounted on shafts spanning nearly the length of the housing. As the length and rotational speed of these shafts increase, so does tool chatter. To avoid poor surface finish, runout, and eccentricity, then, tool speed with this approach must be carefully monitored and controlled.

In some air cycle machines a third housing segment, used to support a compressor rotor shroud, is included between the two journal bearing housing segments. The compressor rotor shroud encircles the rotor and blades, limiting airflow over the tips of the compressor blades. Minimizing the rate of air flowing over these tips, and hence improving compressor efficiency, requires minimizing the clearance between the shroud and the compressor blades. Ideally, then, the pilots on this third housing segment are held concentric with the journal bearing bores, since the radial location of the compressor rotor is fixed by the shaft, which is in turn located by the bearings. Practically, however, this concentricity can only be held within some tolerance. To account for this tolerance, the design clearance between the blade tips and the compressor rotor shroud is increased, increasing also the rate at which air escapes past the compressor blade tips.

DISCLOSURE OF INVENTION

Objects of the present invention include an improved air cycle machine manufacturing and assembling method.

According to the present invention, prior to being releasably joined, housing segments that encase and support, via radial support means, a rotating assembly are first radially and axially aligned by means of a fixture adapted to engage annular volumes designed to locate the radial support means.

Many of the benefits accruing to production processes employing the present invention stem from aligning the housing segments with respect to the inside diameters of the bearing O-ring glands. According to the present invention, the bearing bores and O-ring glands are machined prior to installing the individual segments on the fixture. Two expensive machining steps used in the prior art to orient the housing segments, pilot machining and the match machining, are therefore unnecessary with the present invention. Furthermore, housing segment alignment is obtained with respect to the inside diameters of the O-ring glands directly. Since these gland inside diameters determine the orientation of the bearing assemblies, and hence the shaft, housing alignment with respect to the rotating components fixed to the shaft is therefore improved.

Improved housing and shaft orientation is of particular importance if a portion of one of the housing segments serves as a turbine or compressor rotor shroud or shroud locator. Since the radial location of the rotating components, with respect to the housing assembly, is known to greater accuracy with the present invention, shroud and shaft concentricity can be maintained within tighter tolerances. Given these tighter concentricity tolerances, either the clearances between the blade tips and the shroud can be reduced to improve performance, or the manufacturing tolerances of both the blades and the shroud can be relaxed to lower overall air cycle machine production cost.

The foregoing and other objects, features, and inventions of the present invention will become more apparent in the light of the following detailed description of exemplary embodiments thereof, as illustrated in the accompanying drawings.

BRIEF DESCRIPTION OF DRAWING

The sole FIGURE is a broken away side view showing both a partially-completed air cycle machine housing and an assembly fixture.

BEST MODE FOR CARRYING OUT THE INVENTION

Referring now to the FIGURE, a fan housing segment 10, a compressor housing segment 12, and a bearing housing segment 14 are all assembled onto a fixture 16 to form an air cycle machine housing 18. The fan 10 and bearing 14 housing segments, separated by the compressor housing segment 12, are located at the forward and the aft ends, respectively, of the housing 18. The three housing segments 10, 12, 14 constitute the static components of the air cycle machine, and serve primarily to encase and support the air cycle machine rotating assembly (not shown).

Prior to assembly, both the fan 10 and the bearing 14 housing segments are provided with an annular volume sized to accept the radial support means chosen to support the air cycle machine rotating assembly. In the preferred embodiment, this radial support means comprises a pair of journal bearings (not shown). Each annular volume therefore consists of a journal bearing bore 20, 22 and an O-ring gland set 24, 26. Each O-ring gland set 24, 26 consists of two O-ring glands, one at each end of the journal bearing bores 20, 22. Following the machining of the bores 20, 22 and the O-ring gland sets 24, 26, O-rings are installed into each of the O-ring glands.

With the O-rings installed, the forward end 28 of the fixture 16 is then inserted into the aft end of the fan journal bearing bore 20. The outside diameter of the fixture 16 at the forward end 28 is identical to the outside diameter of the outer race (not shown) of the journal bearing chosen for the fan journal bearing bore 20. The fixture 16 is therefore radially supported by the O-rings installed in the fan O-ring gland set 24. The fixture 16 is forced through the fan journal bearing bore 20 until a shoulder 30 on the fixture contacts the aft face 35 of the fan journal bearing bore 20, fixing the axial location of the fixture 16 with respect to the fan housing segment 10.

When the fixture 16 is firmly seated in the fan journal bearing bore 20, the compressor housing segment 12 is forced over the aft end 32 of the fixture 16 until a forward mating flange 31 on the compressor housing segment 12 contacts a mating flange 33 on the fan housing segment 10. This axially locates the compressor housing segment 12 with respect to both the fixture 16 and the fan housing segment 10. An axisymmetric flange 34 on the fixture 16 has an outside diameter equal to the outside diameter of a compressor shroud (not shown) chosen for the air cycle machine. An O-ring installed in an O-ring gland 36 in this axisymmetric flange 34 contacts the inner surface of the compressor housing segment 12 at the point where the compressor shroud (not shown) will be positioned radially aligning the compressor housing segment 12.

With the fan 10 and compressor 12 housing segments in place, the bearing housing segment 14 is then forced over the aft end 32 of the fixture 16. When the bearing housing segment 14 is fully seated, a mating flange 37 on its forward face contacts an aft mating flange 39 on the compressor housing segment 12, and a shoulder 38 on its aft face contacts a mating shoulder 40 at the aft end of the fixture 16. Similar to the fan housing segment 10, the bearing housing segment 14 is radially supported by the O-rings installed in the compressor O-ring gland set 26. To ensure that these O-rings contact the fixture 16, the outside diameter of the portion of the fixture 16 passing through the journal bearing bore 22 is equal to the outside diameter of the outer race (not shown) of the journal bearing selected for this bore 22.

With the three housing segments 10, 12, 14 installed on the fixture 16, the relative orientation of each segment with respect to the other two is fixed. To preserve these orientations, a series of axial holes 42, 44 are drilled about the circumference of the assembled housing 18, both where the fan mating flange 33 contacts the forward compressor mating flange 31, and where the aft compressor mating flange 39 contacts the bearing mating flange 37. These holes 42, 44 are subsequently reamed and dowel pinned. This ensures that when the housing 18 is reassembled to form a completed air cycle machine after being disassembled to both remove the fixture 16 and install all necessary components (not shown), the position established while the three housing segments 10, 12, 14 are installed on the fixture 16 is retained.

Although the invention has been shown and described with respect to exemplary embodiments thereof, it should be understood by those skilled in the art that various changes, omissions, and additions may be made therein and thereto, without departing from the spirit and scope of the invention.

We claim:

1. A method for aligning and assembling an air cycle machine including a rotating assembly encased in a stationary housing formed of a plurality of static housing segments and supported for rotation therein via a pair of axially spaced journal bearing means, a first of said journal bearing means supported on a first segment of said housing and a second of said journal bearing means supported on a second segment of said housing, said first and second journal bearing means each having an outer bearing race having a desired outer diameter; said method comprising the steps of:

machining an axially extending bearing bore of a desired diameter into each of said first housing segment and said second housing segment;

installing an O-ring into the bearing bore of each of said first housing segment and said second housing segment;

fitting a forward end of a fixture means into the bearing bore of said first housing segment whereby the forward end of the fixture means is supported by the O-ring in the bearing bore of said first housign segment and a central portion and an aft end of said fixture means extends coaxially outwardly from said first housing segment;

installing an intermediate housign segment onto the central portion of said fixture means whereby said intermediate housing segment is radially aligned with a first end of said intemediate housing segment abutting said first housing segment at an interface therebetween;

fitting the bearing bore of said second housing segment onto the aft end of said fixture means whereby the aft end of said fixture means is supported by the O-ring in the bearing bore of said second housing segment and said second housing segment abuts a second end fo said intermediate housing segment at an interface therebetween;

forming a first series of axially aligned holes through said first and intermediate housing segments at circumferentially spaced intervals about the periphery of the interface between said intermediate housings egment and said first housing segment disposed on said fixture means and forming a second series of axially aligned hoels through said second and intermediate housing segments at circumferentially spaced intervals about the periphery of the interface between said intermediate housing segment and said second housing segment disposed on said fixture means;

disassembling said first, said intermediate and said second housing segments from said fixture means;

installing said first journal bearing means in said first housing segment and said second journal bearing means ins aid second housing segment; and assembling said first, said intermediate and said second housing segments together by inserting fastening means into and through said first series of axially aligned holes mated, thereby retaining the relative position of said first and said intermediate housing segments established when said first and said intermediate housing segments where first assembled on said fixture means and by inserting fastening means into and through said second series of axially aligne3d holes mated, thereby retaining the relative position of said intermediate and said second housing segments established when said second and said intermediate housing segments where first assembled on said fixture means, with said assembling step being performed without the housing segments located on the fixture means.

* * * * *